US009217430B2

(12) United States Patent
Smith et al.

(10) Patent No.: US 9,217,430 B2
(45) Date of Patent: Dec. 22, 2015

(54) SEMI-PLUGGED STAR GEROTOR AND METHOD OF ASSEMBLING THE SAME

(75) Inventors: Stephen D. Smith, Plymouth, MN (US); Hiroshi Matsui, Kyoto (JP); Vijay A. Karambalkar, Maharashtra (IN)

(73) Assignee: Eaton Corporation, Cleveland, OH (US)

( * ) Notice: Subject to any disclaimer, the term of this patent is extended or adjusted under 35 U.S.C. 154(b) by 1098 days.

(21) Appl. No.: 12/985,396

(22) Filed: Jan. 6, 2011

(65) Prior Publication Data

US 2012/0177518 A1 Jul. 12, 2012

(51) Int. Cl.

| | |
|---|---|
| ***F01C 1/02*** | (2006.01) |
| ***B62D 5/093*** | (2006.01) |
| ***F04C 2/10*** | (2006.01) |
| ***F04C 15/00*** | (2006.01) |

(52) U.S. Cl.

CPC ..... *F04C 2/102* (2013.01); *F04C 2/103* (2013.01); *F04C 15/0026* (2013.01)

(58) Field of Classification Search

CPC ..... F04C 15/0026; F04C 2/102
USPC ..... 418/61.3, 104.7, 110, 131, 133, 134, 418/140, 142, 144
See application file for complete search history.

(56) References Cited

U.S. PATENT DOCUMENTS

| | | | | |
|---|---|---|---|---|
| 4,145,167 | A | 3/1979 | Baatrup | |
| 4,666,382 | A * | 5/1987 | Eisenmann | 418/61.3 |
| 4,715,798 | A * | 12/1987 | Bernstrom | 418/57 |
| 4,756,676 | A | 7/1988 | Bernstrom | |
| 4,830,592 | A * | 5/1989 | Weidhaas | 418/132 |
| 5,136,844 | A * | 8/1992 | Stephenson et al. | 60/384 |
| 5,167,398 | A * | 12/1992 | Wade et al. | 251/149.6 |
| 5,211,551 | A * | 5/1993 | Uppal et al. | 418/61.3 |
| 5,624,248 | A * | 4/1997 | Kassen et al. | 418/61.3 |
| 6,071,102 | A | 6/2000 | Hjelsand | |
| 6,086,345 | A * | 7/2000 | Acharya et al. | 418/61.3 |

FOREIGN PATENT DOCUMENTS

| | | | |
|---|---|---|---|
| CN | 1217432 | A | 5/1999 |
| CN | 1409039 | A | 4/2003 |
| CN | 1576586 | A | 2/2005 |
| CN | 201627914 | U | 11/2010 |
| CN | 201651318 | U | 11/2010 |
| DE | 1653837 | A1 | 3/1975 |
| DE | 102005004657 | A1 | 8/2006 |
| EP | 1659289 | A2 | 5/2006 |

(Continued)

*Primary Examiner* — Mary A Davis
*Assistant Examiner* — Anthony Ayala Delgado
(74) *Attorney, Agent, or Firm* — Quinn Law Group, PLLC

(57) ABSTRACT

A gerotor assembly includes a star, a ring, and an annular plug member, as well as an o-ring. The star member defines a center opening of a first diameter which is connectable to a low-pressure fluid reservoir. The ring member circumscribes the star member. The ring member defines, in conjunction with a stationary end cap of a fluid control device, a fluid channel connectable to a high-pressure fluid supply. The plug member is circumscribed by the star member, and defines a center bore of a second diameter less than the first diameter. The o-ring is positioned between the star and the plug members. The plug member forms a fluid seal against the end cap. A fluid control device includes the above gerotor assembly and a valve housing section. A method of assembling the gerotor assembly and fluid control device are also disclosed.

15 Claims, 2 Drawing Sheets

(56) References Cited

FOREIGN PATENT DOCUMENTS

| | | | |
|---|---|---|---|
| JP | S59154878 | U | 10/1984 |
| JP | H0251972 | U | 4/1990 |
| JP | H04272582 | A | 9/1992 |

* cited by examiner

SEMI-PLUGGED STAR GEROTOR AND METHOD OF ASSEMBLING THE SAME

TECHNICAL FIELD

The present invention relates generally to a gerotor assembly for use within a fluid control device, and in particular to a semi-plugged star gerotor and a method of assembling the same.

BACKGROUND

Star gerotors are positive-displacement fluid pumping devices having meshed inner and outer rotors. The inner and outer rotors are typically referred to as a star member and a ring member, respectively. Each rotor has a fixed center point that is eccentric with respect to the center point of the other rotor. The star member has n teeth, and is circumscribed by the ring member having (n+1) lobes. Rotation of one rotor drives the other, with a low relative speed maintained between the two rotors. The volume defined between the mating teeth/lobes of the engaged rotors creates a vacuum during gerotor rotation, and thus a resultant suction or intake stage for each revolution of the gerotor.

A steering control unit (SCU) of a hydrostatic power steering system is one type of fluid control device that commonly uses a star gerotor in its construction. An SCU may experience slip between its rotating gerotor members and a stationary member, e.g., an end cap which is secured adjacent to the gerotor. For example, when a steering cylinder controlled via a valve housing section of the SCU reaches the limit of its range of travel, a steering wheel controlled via the SCU may still rotate beyond this limit. Such additional rotation is often a result of internal fluid leakage between the star member and an adjacent surface of the stationary end cap.

SUMMARY

A gerotor assembly is provided herein for use with a fluid control device such as the SCU noted above. The gerotor assembly disclosed herein is semi-plugged, i.e., a hybrid between a solid plug-style star seal design and a conventional sealing ring, as set forth in detail below. The gerotor assembly includes a star member, a ring member, an annular plug member, and an o-ring. The star member has (n) teeth, and defines a center opening of a first diameter. The center opening is in fluid communication with a low-pressure fluid reservoir when the gerotor assembly is installed in the fluid control device. The ring member circumscribes the star member, and has (n+1) lobes that mesh with the (n) teeth, as is well understood in the art of gerotors.

The ring member is configured to define, in conjunction with a stationary end cap of the fluid control device, a high-pressure fluid channel, i.e., a fluid channel that is connectable to a high-pressure fluid supply. The annular plug member is circumscribed by the star member, and defines a center bore of a second diameter that is smaller than the first diameter. The o-ring is positioned between the star member and the annular plug member. The annular plug member is thus configured to form a semi-plugged fluid seal against the stationary end cap of the fluid control device, with various performance benefits as explained below.

A fluid control device is also disclosed. The fluid control device includes a gerotor star member, a gerotor ring member, an annular plug member, an o-ring, and a valve housing section. The star member defines a center opening of a first diameter, with the center opening in fluid communication with a low-pressure fluid reservoir. The ring member circumscribes the star member, and has (n+1) lobes that engage with the (n) teeth of the star member. The plug member is circumscribed by the star member, and defines a center bore of a second diameter less than the first diameter.

The center bore is in fluid communication with the low-pressure fluid reservoir via the center opening. The o-ring is positioned between the star member and the annular plug member. The o-ring is in fluid communication with the high-pressure fluid reservoir via a high-pressure fluid channel, and with the low-pressure fluid reservoir via the center opening. The valve housing section has a stationary end cap and a wear plate, with the end cap positioned immediately adjacent to the annular plug member to define the high-pressure fluid channel in conjunction with the star member. The high-pressure fluid channel is in fluid communication with a high-pressure fluid reservoir.

A method is also disclosed herein, including providing a gerotor star member defining an annular shelf and a center opening of a first diameter, and circumscribing the star member with a gerotor ring member such that (n+1) lobes of the ring member engage with (n) teeth of the star member. The method includes positioning an o-ring on a surface of the star member, and providing an annular plug member that defines a center bore of a diameter less than the first diameter. The annular plug member is placed on the o-ring such that the annular plug member is circumscribed by the star member to thereby form the gerotor assembly.

The above features and advantages and other features and advantages of the present invention are readily apparent from the following detailed description of the best modes for carrying out the invention when taken in connection with the accompanying drawings.

DESCRIPTION

Figure 1:
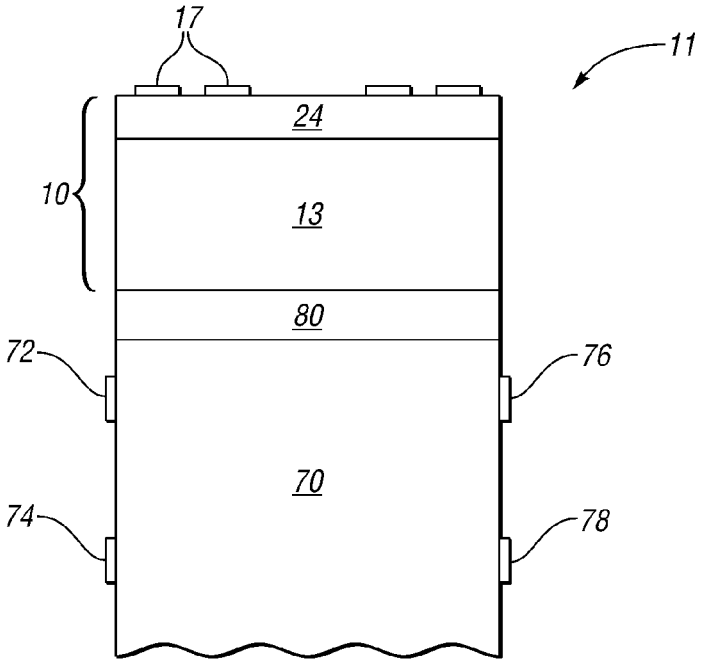
FIG. 1 is a schematic illustration of a fluid control device using a semi-plugged gerotor assembly of the type disclosed herein.

Referring to the Figures, wherein like reference numbers correspond to similar components, FIG. 1 is a schematic illustration of a fluid control device 11. The fluid control device 11 includes a semi-plugged gerotor assembly 13. The gerotor assembly 13 has an annular plug member 18 forming a star seal. As described in detail below, the annular plug member 18 is configured to reduce internal fluid leakage within the fluid control device 11 in which the plug member 18 is installed.

In one possible embodiment, the fluid control device 11 may be configured as a steering control unit (SCU) for use in a hydrostatic power steering system. The gerotor assembly 13 may be included as part of an SCU to reduce undesirable steering wheel rotation while reducing friction losses relative to conventional designs, thereby increasing energy efficiency. Other fluidic systems in which fluid leakage from a high-pressure side to a low-pressure side is a critical design concern, such as fluid motors pumping systems, may likewise benefit from use of the semi-plugged gerotor assembly 13 and its annular plug member 18 as described herein.

Within the fluid control device 11 shown in FIG. 1, the gerotor assembly 13 may be bolted or otherwise securely fastened to a valve housing section 70, e.g., via bolts 17. A stationary wear plate 80 is disposed between the gerotor assembly 13 and the valve housing section 70. The gerotor assembly 13 is positioned between the wear plate 80 and a stationary end cap 24. The valve housing section 70 may define various fluid ports, including a fluid inlet port 72, a fluid return port 74, and various cylinder control ports, e.g., control ports 76 and 78, either on one side of the valve housing section 70 or distributed as shown. A fluid device subassembly 10 is formed by the gerotor assembly 13 and the end cap 24, and is described below with reference to FIGS. 3 and 4.

Although not show in FIG. 1 for simplicity, the interior of the valve housing section 70 defines a bore containing any required valves and associated control devices for actuating the device being controlled, e.g., a rotatable spool and a cooperating, relatively rotatable follow up valve member, as is well understood in the art. The follow up valve member may be driven using a main drive shaft (not shown), with the main shaft splined to and rotatable in conjunction with the semi-plugged gerotor assembly 13.

Figure 2:
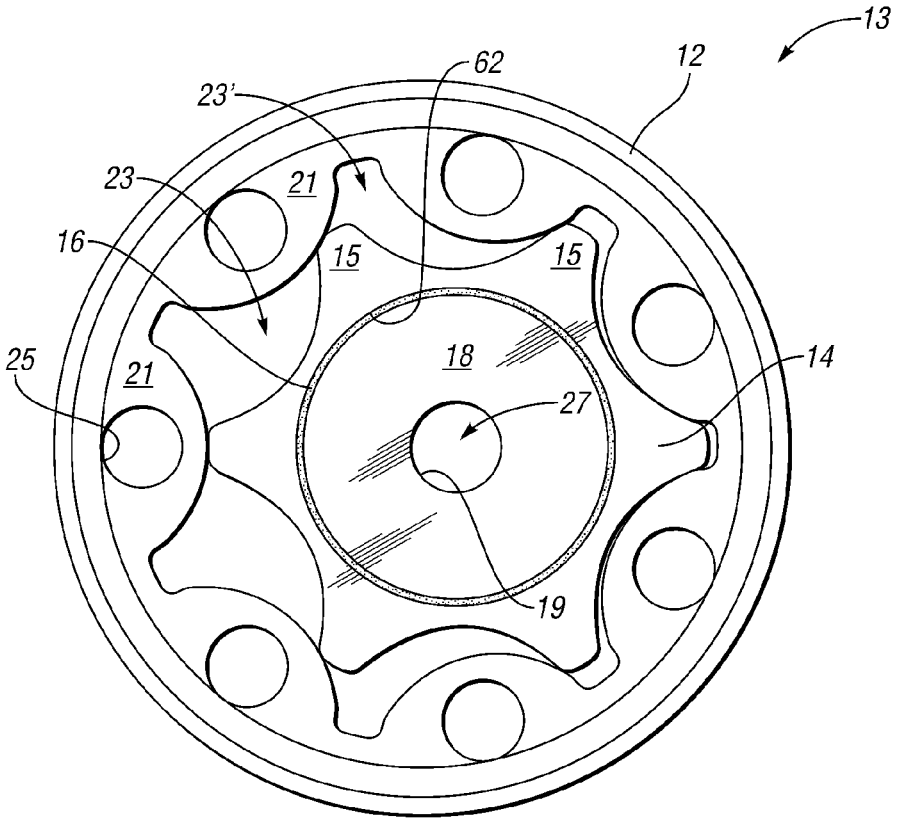
FIG. 2 is a schematic plan view illustration of the present gerotor assembly.

Referring to FIG. 2, the gerotor assembly 13 includes an internally-toothed outer rotor, which is referred to hereinafter as a ring member 12. The gerotor assembly 13 further includes an externally-toothed inner rotor, i.e., a star member 14. The star member 14 is eccentrically disposed within the ring member 12 for orbital and rotational movement therein. Both the star member 14 and the ring member 12 may be constructed of steel, powder metal, or another suitable metallic material.

The star member 14 defines an annular, axial wall 62. The axial wall 62 defines a center opening (arrow 20) as shown in FIG. 4. The star member 14 may includes splines 22 (see FIGS. 3 and 4) to allow the star member 14 to engage with mating splines of a main drive shaft (not shown) positioned within the valve housing section 70 of FIG. 1. As understood in the art of gerotors, a plurality (n) of teeth 15 of the star member 14 mesh with or engage with a larger plurality (n+1) of teeth or lobes 21 of the ring member 12 to define multiple fluid volume chambers (arrows 23). The fluid volume chambers (arrows 23) are in fluid communication with the valve housing section 70 of FIG. 1 through passages (not shown) defined by the wear plate 80 shown in the same Figure.

The bolts 17 of FIG. 1 pass through the stationary end cap 24 (see FIG. 1) and through a plurality of bolt holes 25 defined by the ring member 12 in order to fasten the semi-plugged gerotor assembly 13 to the valve housing section 70 shown in FIG. 1. Within the star member 14, the axial wall 62 intersects a radial floor 60 (see FIGS. 3 and 4) to thereby form a radial shelf, with the position of the radial shelf generally indicated by reference number 44 in FIG. 3. As used herein, the term "axial wall" refers to a wall extending in the same direction as the axis of rotation of the star member 14, and the term "radial floor" refers to a floor extending in a direction perpendicular to the same axis.

The annular plug member 18 has a bore wall 19 forming a center bore as indicated by arrow 27. The annular plug member 18 is positioned on the radial floor 60 shown in FIGS. 3 and 4. When the semi-plugged gerotor assembly 13 is installed in the fluid control device 11 of FIG. 1 or another suitable device, a dynamic fluid seal is formed between the annular plug member 18 and the stationary end cap 24 shown in that Figure. Both the structure and the function of the annular plug member 18 are described in detail with reference to FIGS. 3 and 4.

Assembly to various levels may be accomplished by circumscribing the star member 14 with the ring member 12 such that the lobes 21 of the ring member 12 engage with the teeth 15 of the star member 14. The o-ring 16 is positioned on the radial shelf 44 (see FIGS. 3 and 4) of the star member 14. The annular plug member 18 is then placed on the o-ring 16 and the radial shelf 44. Subsequently connecting the assembled gerotor assembly 13 to the stationary end cap 24 defines a high-pressure fluid channel (arrow 82 of FIG. 4) between the star member 14 and the end cap 24. The center opening (arrow 20) is then connected to a low-pressure fluid reservoir 40 as shown in FIG. 4, and the fluid channel (arrow 82) of FIG. 4 is connected to a high-pressure fluid reservoir 30.

Figure 3:
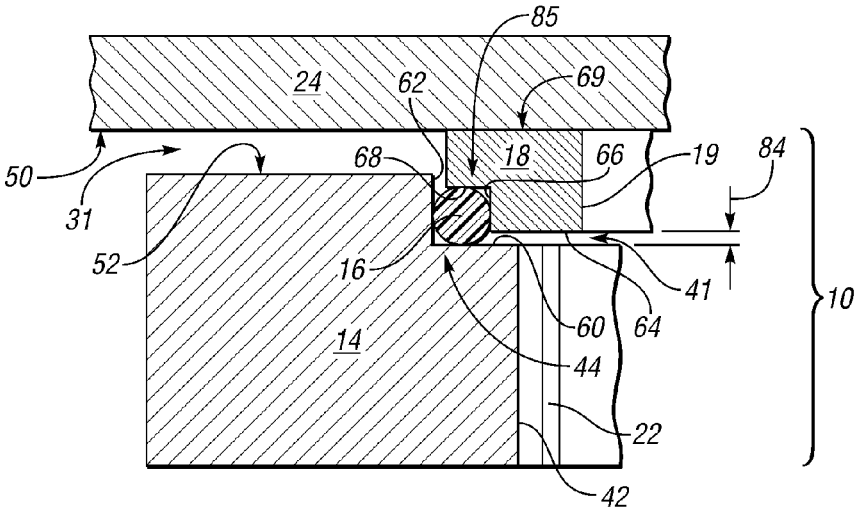
FIG. 3 is a partial schematic cross-sectional side view illustration of a portion of the fluid control device shown in FIG. 2, including the gerotor assembly and a stationary end cap of the fluid control device of FIG. 1.
Figure 4:
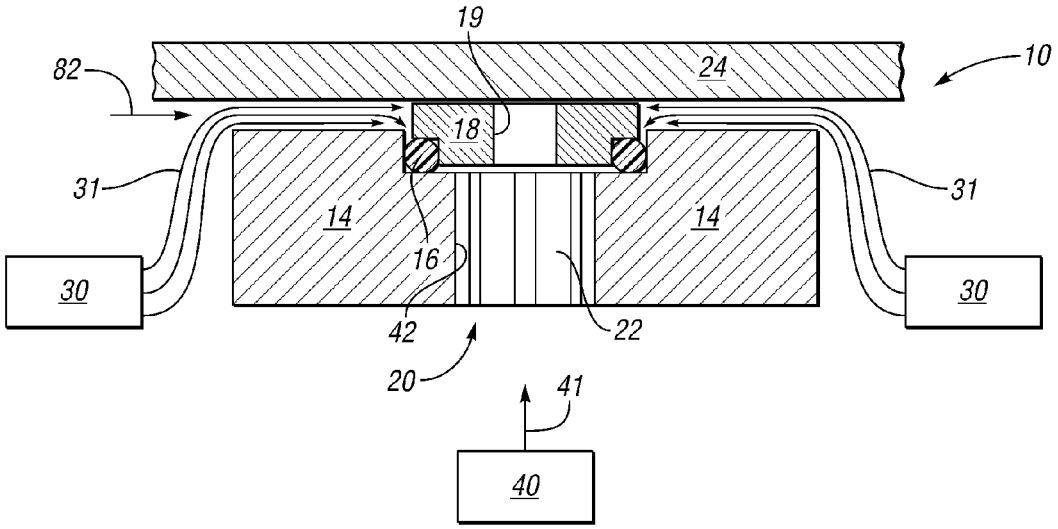
FIG. 4 is a schematic cross-sectional illustration of a portion of the fluid control device shown in FIG. 1, including the portion shown in FIG. 3.

Referring to FIG. 3, a partial cross-sectional side view is shown of the fluid device subassembly 10 of FIG. 1. FIG. 3 is not intended to be drawn to scale with respect to FIG. 1, 2, or 4, but rather to provide a close-up view of certain internal structural portions of the fluid device subassembly 10. When the semi-plugged gerotor assembly 13 is connected to the stationary end cap 24, a high-pressure fluid channel is defined between an upper surface 52 of the star member 14 and the underside 50 of the end cap 24. High-pressure fluid (arrow 31) enters the fluid channel, which is indicated by arrow 82 in FIG. 4, causing sealing to occur as explained below with reference to FIG. 4.

The axial wall 62 and the radial floor 60 of the star member 14 form the radial shelf 44, on which an o-ring 16 is disposed. The o-ring 16 forms a fluid seal between the star member 14 and the annular plug member 18. The o-ring 16 may be constructed of a suitable wear-resistant elastomeric material having a hardness level sufficient for resisting extrusion in pressurized operation. In one embodiment, the o-ring 16 is provided with a hardness level of at least approximately 90 durometer on the ASTM D2240 type D scale, i.e., 90D hardness. Suitable materials at this hardness level may include, without being limited to, Nitrile Butadiene Rubber (NBR), Hydrogenated NBR (HNBR), polyurethane, etc.

The annular plug member 18 is used to form a seal against an underside 50 of the end cap 24, and may be constructed of steel, powder metal, high hardness resin-based materials, or other suitable materials. The annular plug member 18, which has a generally L-shaped cross section as shown, includes a first surface 66 and a second surface 68, which are perpendicular with respect to each other to form a circumferential notch 85 facing the annular radial shelf 44. The first surface 66 and a second surface 68 are both in direct contact with the o-ring 16, which is disposed at least partially within the circumferential notch 85. A third surface 69 of the annular plug member 18 is in direct frictional contact with the underside 50 of the end cap 24. As used herein, the term "underside" refers to the particular major surface or side of the end cap 24 that is positioned immediately adjacent to the star member 14 within the fluid control device 11 (see FIG. 1) in which the star member 14 is used.

The star member 14, the annular plug member 18, and the o-ring 16 rotate together with respect to the stationary end cap 24. The center section or internal diameter (ID) of the star member 14 defined by an inner wall 42 is connected to a low-pressure fluid reservoir 40, and the all other sides of the star member 14 are connected to a high-pressure fluid reservoir 30. Both of the reservoirs 30 and 40 are shown schematically in FIG. 4. The terms "low" and "high" are relative fluid pressures. In one embodiment, "low pressure" may be approximately 0 to approximately 40 bar, while "high pressure" is any pressure in excess of 40 bar. In another embodiment, 70 to 150 bar may be used as a high pressure range, although high pressure could vastly exceed 150 bar depending on the application. The placement and use of the annular plug member 18 and the o-ring 16 as described herein helps to reduce leakage of high-pressure fluid (arrow 31) to the low-pressure fluid reservoir 40 of FIG. 4.

Referring to FIG. 4 in conjunction with FIG. 3, the stationary end cap 24 extends to include the ring member 12 of FIG. 2, and is therefore shown in broken line form in FIGS. 3 and 4. The inner wall 42 of the star member 14 defines the center opening (arrow 20) of FIG. 4. The center opening (arrow 20) is in fluid communication with the low-pressure fluid reservoir 40 of FIG. 3, such that low-pressure fluid (arrow 41) is in communication with the o-ring 16, the annular plug member 18, and the end cap 24 via the center opening (arrow 20). The o-ring 16 may be preloaded to form a sufficient seal against the star member 14 and the annular plug member 18.

The area of contact between the annular plug member 18 and the end cap 24 should be sufficiently large so as to reduce leakage past the end cap 24, the star member 14, and the o-ring 16 from the high-pressure side to the low-pressure side, and yet small enough to minimize friction losses. Thus, the annular plug member 18 forms only a partial plug, i.e., the term "semi-plugged" as used herein. In one embodiment, the diameter of the center bore as defined by the bore wall 19 of the annular plug member 18 is between approximately 60% to approximately 75% of the outer diameter (OD) of the annular plug member 18.

As noted above, the fluid device subassembly 10 shown in FIG. 4 is in fluid communication with high-pressure fluid (arrows 31) delivered from the high-pressure fluid reservoir 30. A high-pressure fluid channel (arrow 82), as shown in FIG. 4, is defined between the underside 50 of the end cap 24 and an upper surface 52 of the star member 14 as noted above, with the surfaces 50 and 52 being adjacent to each other.

The o-ring 16 is in fluid communication with the high-pressure fluid reservoir 30 of FIG. 4 via the high-pressure fluid channel (arrow 82), and with the low-pressure fluid reservoir 40 via the center opening (arrow 20) of the star member 14. The size of a gap (arrows 84 of FIG. 3) between an underside 64 of the annular plug member 18 and the radial floor 60 of the star member 14 should be minimized to prevent extrusion of the o-ring 16 to the low-pressure side during operation.

In operation, high-pressure fluid (arrows 31) enters the high-pressure fluid channel (arrow 82) and pushes against the o-ring 16. This forces the annular plug member 18 into frictional contact with the stationary end cap 24. Fluid leakage from the high-pressure side to the low-pressure side may occur between the o-ring 16 and the star member 14, between the o-ring 16 and the annular plug member 18, and/or between the annular plug member and the end cap 24.

However, since the annular plug member 18 is only semi-plugged, as that term is used herein, a relatively large contact area remains present between the annular plug member 18 and the stationary end cap 24. Fluid leakage is reduced from high-pressure side to the low-pressure side relative to conventional gerotor star seal designs. Additionally, since the contact area between the annular plug member 18 and the end cap 24 is relatively small in the present semi-plugged design relative to a solid-plug design, frictional losses are concurrently reduced in this area. Overall efficiency is thereby increased.

While the best modes for carrying out the invention have been described in detail, those familiar with the art to which this invention relates will recognize various alternative designs and embodiments for practicing the invention within the scope of the appended claims.

The invention claimed is:

1. A gerotor assembly for a fluid control device, comprising:

a star member having a number (n) of teeth, wherein the star member has an upper surface and defines a center opening which is connectable to a low-pressure fluid reservoir;

a ring member circumscribing the star member, and having a number (n+1) of lobes that mesh with the number (n) of teeth, wherein the star member is configured to define, in conjunction with a stationary end cap of the fluid control device, a fluid channel between the upper surface of the star member and an underside of the end cap that is connectable to a high-pressure fluid supply; and an annular plug member that is circumscribed by the star member, wherein the annular plug member defines a center bore connectable to the low-pressure fluid reservoir; and an o-ring positioned between the star member and the annular plug member;

wherein the annular plug member is configured to form a fluid seal against the stationary end cap of the fluid control device when high-pressure fluid enters the fluid channel and pushes against the o-ring to thereby force the annular plug member into frictional contact with the stationary end cap.

2. The gerotor assembly of claim 1, wherein the star member defines a radial shelf, the o-ring is positioned on the radial shelf, the plug member defines a circumferential notch on a surface of the annular plug member facing the radial shelf, and the o-ring is disposed at least partially within the circumferential notch.

3. The gerotor assembly of claim 1, wherein the o-ring is constructed of a wear-resistant elastomeric material having a hardness level of at least approximately 90 durometer.

4. The gerotor assembly of claim 3, wherein the wear-resistance elastomeric material is one of Nitrile Butadiene Rubber (NBR), Hydrogenated NBR (HNBR), and polyurethane.

5. The gerotor assembly of claim 1, wherein the center bore has a diameter that is approximately 60 percent to approximately 75 percent of an outer diameter of the annular plug member.

6. A fluid control device comprising:

a gerotor star member having an upper surface and defining a center opening in fluid communication with a low-pressure fluid reservoir;

a gerotor ring member circumscribing the star member, and having a number (n+1) of lobes that engage with a number (n) of teeth of the star member;

an annular plug member that is circumscribed by the star member, wherein the annular plug member defines a center bore in fluid communication with the low-pressure fluid reservoir via the center opening;

an o-ring positioned between the star member and the annular plug member, wherein the o-ring is in fluid communication with the high-pressure fluid reservoir via a high-pressure fluid channel, and with the low-pressure fluid reservoir via the center opening; and a valve housing section having a stationary end cap and a wear plate, wherein the stationary end cap includes an underside that is positioned immediately adjacent to the annular plug member to thereby define the high-pressure fluid channel in conjunction with the upper surface of the star member, and wherein the high-pressure fluid channel is in fluid communication with a high-pressure fluid reservoir;

wherein the fluid control device is configured to allow fluid to enter the high-pressure fluid channel and push against the o-ring to thereby force the annular plug member into frictional contact with the stationary end cap.

7. The fluid control device of claim 6, wherein the star member defines a radial shelf, the o-ring is disposed on the radial shelf, the annular plug member defines a circumferential notch on a surface of the annular plug member facing the radial shelf, and the o-ring is disposed at least partially within the circumferential notch.

8. The fluid control device of claim 7, wherein the o-ring is constructed of a wear-resistant elastomeric material having a hardness level of at least approximately 90 durometer.

9. The fluid control device of claim 8, wherein the wear-resistance elastomeric material is one of Nitrile Butadiene Rubber (NBR), Hydrogenated NBR (HNBR), and polyurethane.

10. The fluid control device of claim 6, wherein the center bore has a diameter that is approximately 60 percent to approximately 75 percent of an outer diameter of the annular plug member.

11. The fluid control device of claim 6, wherein the fluid control device is configured as a steering control unit for a hydrostatic power steering system.

12. A fluid device, comprising:

a ring member;

a star member eccentrically disposed within the ring member for orbital and rotational movement therein, the star member having a first surface;

a second surface disposed immediately adjacent to the first surface of the star member, the second surface and the first surface of the star member defining a fluid channel between the second surface and the first surface of the star member; and an annular plug member defining a center bore and circumscribed by the star member, the annular plug member including a third surface;

wherein high-pressure fluid in the fluid channel acts against the annular plug member to force the third surface of the annular plug member into frictional contact with the second surface immediately adjacent to the first surface of the star member; and wherein the star member defines a center opening in fluid communciation with low-pressure fluid.

13. The fluid device of claim 12, wherein the fluid device is a steering control unit.

14. The fluid device of claim 12, further comprising an o-ring disposed between the star member and the annular plug member.

15. The fluid device of claim 14, wherein the center bore has a diameter that is between approximately 60% and approximately 75% of an outer diameter of the annular plug member.

* * * * *